US011019932B2

(12) United States Patent
Brichet

(10) Patent No.: US 11,019,932 B2
(45) Date of Patent: Jun. 1, 2021

(54) MODULAR SEXUAL ASSISTANCE APPARATUS

(71) Applicant: Rodolphe Daniel Raymond Brichet, Vendeuvre du Poitou (FR)

(72) Inventor: Rodolphe Daniel Raymond Brichet, Vendeuvre du Poitou (FR)

( * ) Notice: Subject to any disclaimer, the term of this patent is extended or adjusted under 35 U.S.C. 154(b) by 531 days.

(21) Appl. No.: 15/998,644

(22) PCT Filed: Feb. 12, 2017

(86) PCT No.: PCT/IB2017/050774
§ 371 (c)(1),
(2) Date: Aug. 16, 2018

(87) PCT Pub. No.: WO2017/141146
PCT Pub. Date: Aug. 24, 2017

(65) Prior Publication Data

US 2020/0329879 A1 Oct. 22, 2020

(30) Foreign Application Priority Data

Feb. 16, 2016 (FR) ..... 1600252

(51) Int. Cl.
*A47C 15/00* (2006.01)
*A61H 19/00* (2006.01)
(Continued)

(52) U.S. Cl.
CPC ..... *A47C 15/008* (2013.01); *A47C 21/006* (2013.01); *A61G 7/05* (2013.01);
(Continued)

(58) Field of Classification Search
CPC ... A61G 5/04; A61G 5/14; A61G 7/00; A61G 7/1025; A61G 7/103; A61G 7/1034;
(Continued)

(56) References Cited

U.S. PATENT DOCUMENTS 5,443,532 A * 8/1995 Hudak ..... A47C 15/008 5/652
5,608,929 A * 3/1997 Crane ..... A61G 7/1026 5/81.1 HS (Continued)

FOREIGN PATENT DOCUMENTS

| | | | |
|---|---|---|---|
| BE | 1018234 | A6 | 7/2010 |
| EP | 3416607 | B1 | 4/2020 |
| JP | H08-224274 | A | 9/1996 |

OTHER PUBLICATIONS

European Notice of Allowance dated Jan. 8, 2020 in counterpart application No. EP 17707407.7 by R. Brichet; w/ English machine translation (total 65 pages).

(Continued)

*Primary Examiner* — Tu A Vo
*Assistant Examiner* — Alexander Morales
(74) *Attorney, Agent, or Firm* — Seckel IP, PLLC

(57) ABSTRACT

The modular sexual assistance apparatus includes a secure structure (A) able to support a user. The secure structure (A) includes a carriage (12) arranged on a linear guide and mounted on a pedestal (8). The linear guide includes a safety device which is suitable for controlling a linear travel of the carriage (12). The linear guide includes a system for slaving by an elastic cable (30). It includes a stopper ball (33) and is suitable for entering both a locking catch (32) secured to the pedestal (8) and a ring (31) secured to the carriage (12). A tensed state of the elastic cable (30) is defined both by a movement of the stopper ball (33) along the pedestal (8) and by a clamped state of the elastic cable (30) in the locking catch (32).

20 Claims, 3 Drawing Sheets

Figure 1:
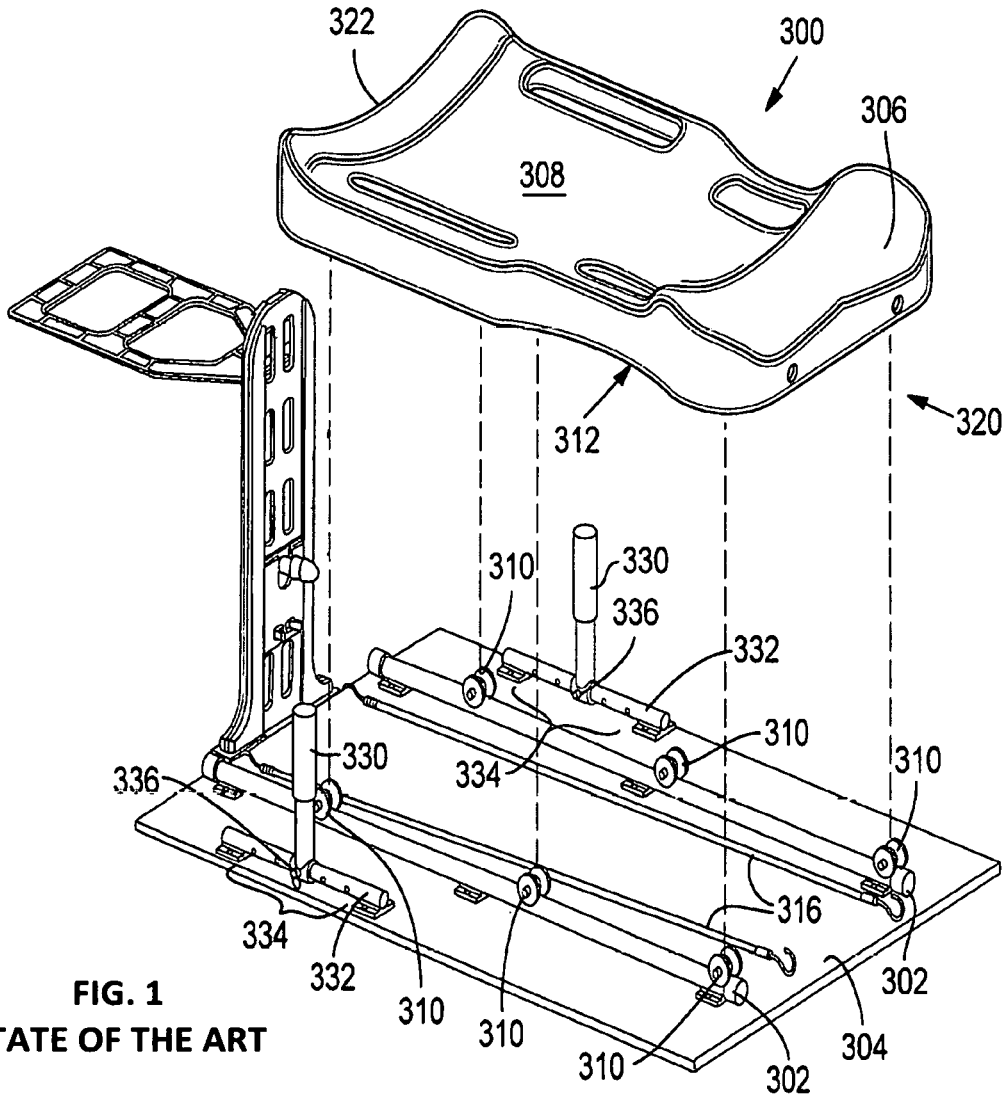

(51) Int. Cl.
*A61G 7/05* (2006.01)
*A47C 21/00* (2006.01)
*A61G 7/10* (2006.01)

(52) U.S. Cl.
CPC ..... *A61G 7/1034* (2013.01); *A61G 7/1067* (2013.01); *A61H 19/32* (2013.01); *A61H 19/34* (2013.01); *A61H 19/44* (2013.01); *A61H 19/50* (2013.01); *A61H 2201/0149* (2013.01); *A61H 2201/123* (2013.01); *A61H 2201/1215* (2013.01); *A61H 2201/1238* (2013.01); *A61H 2201/149* (2013.01); *A61H 2201/1669* (2013.01)

(58) Field of Classification Search
CPC ..... A61G 2203/72; A61G 2203/723; A61H 1/0237; A61H 1/0255; A61H 2003/006; A61H 2003/043; A61H 2003/046; A61H 2201/1633; A61H 2201/165; A61H 2201/5007; A61H 2201/5012; A61H 2201/5025; A61H 2201/5048; A61H 2201/5064; A61H 2201/5092; A61H 2201/5097; A61H 2203/0406; A61H 2203/0431; A61H 1/001–005; A61H 21/00; A61H 19/00; A61H 19/30; A61H 19/32; A61H 19/34; A61H 19/40; A61H 19/44; A61H 19/50; A63B 21/4045; A63B 21/04; A63B 21/0407; A63B 21/0428; A63B 21/0557; Y10S 5/929; A47C 21/006; A47C 15/008
USPC ..... 108/145, 147, 20; 5/81.1 HS, 943, 929; 297/344.11, 344.18, 337
See application file for complete search history.

(56) References Cited

U.S. PATENT DOCUMENTS

| | | | | |
|---|---|---|---|---|
| 5,875,779 | A * | 3/1999 | Fuhrman | A47C 15/008 128/845 |
| 6,199,552 | B1 | 3/2001 | Crespo | |
| 6,698,431 | B1 * | 3/2004 | Harris | A47C 15/008 128/845 |
| 7,431,036 | B2 | 10/2008 | Al-Bannai | |
| 7,524,283 | B1 | 4/2009 | Johnstone, II | |
| 2003/0111876 | A1 | 6/2003 | Black | |
| 2003/0195097 | A1 * | 10/2003 | Wakeman | A47C 15/008 482/148 |
| 2006/0004251 | A1 | 1/2006 | Bookwalter et al. | |
| 2008/0023008 | A1 * | 1/2008 | Al-Bannai | A47C 15/008 128/845 |
| 2008/0271241 | A1 | 11/2008 | Tholkes et al. | |
| 2013/0314866 | A1 * | 11/2013 | Millman | G06F 1/16 361/679.02 |
| 2013/0318717 | A1 * | 12/2013 | Iheoma | A61G 13/08 5/600 |
| 2015/0141749 | A1 * | 5/2015 | Lopez | A61H 19/32 600/38 |

OTHER PUBLICATIONS

International Search Report and Written Opinion dated May 8, 2017 issued in corresponding application No. PCT/IB2017/050774; w/ English partial translation and partial machine translation (24 pages).

* cited by examiner

STATE OF THE ART

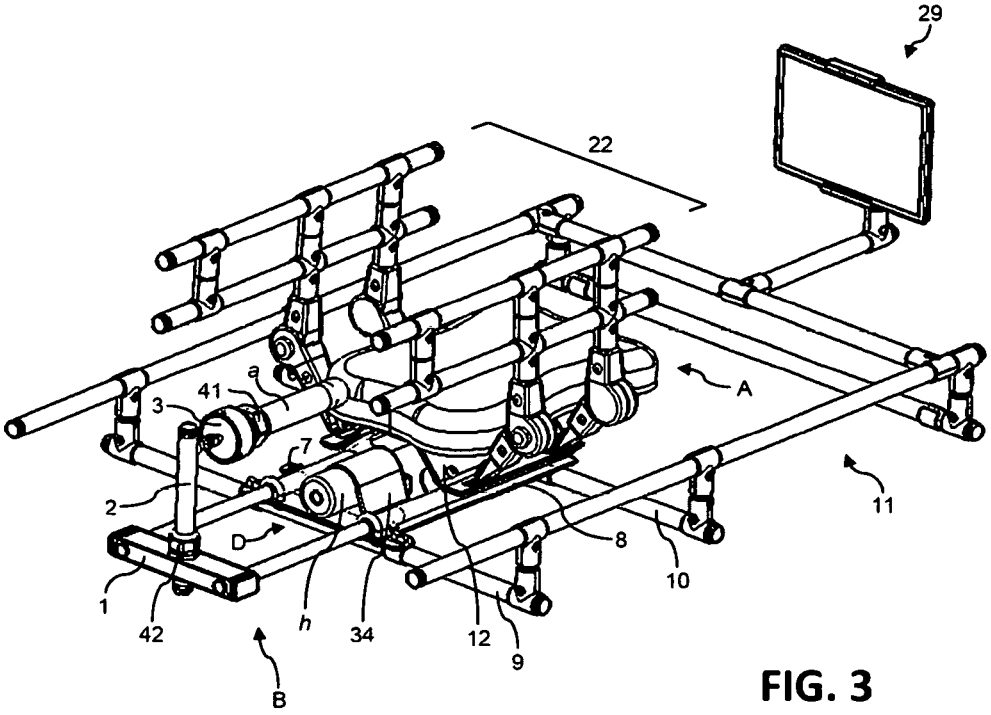
FIG. 3
FIG. 4
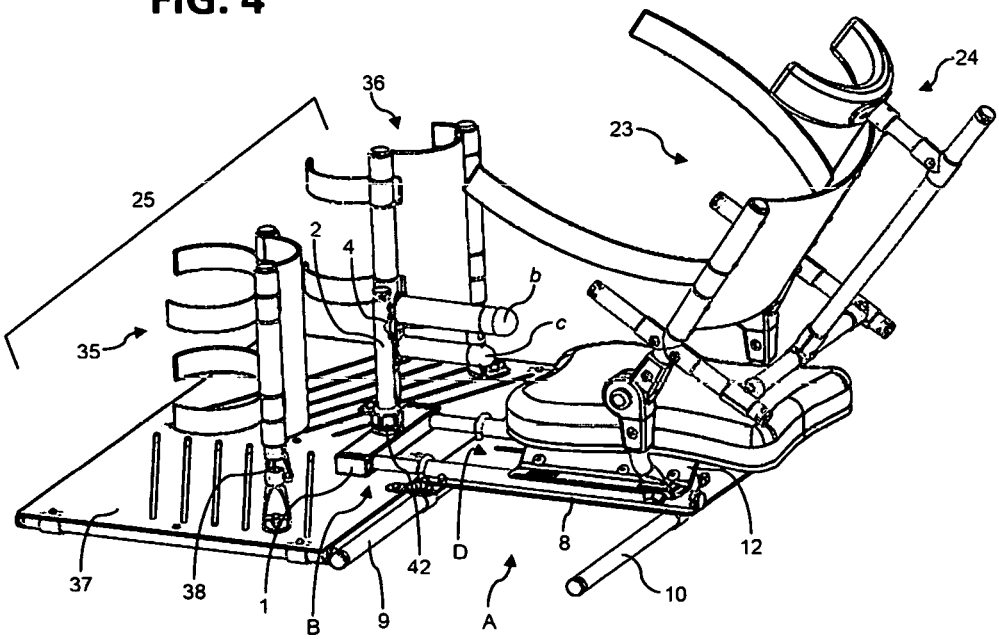

MODULAR SEXUAL ASSISTANCE APPARATUS

The invention relates to a modular sexual assistance apparatus, easily installable on the ground or on a bed, comprising one or two secure structures able to support one or two moving users and including a one-way or two-way multifunctional device for supporting various accessories and modulating the architecture of the assembly.

Such an apparatus can be used for a sexual encounter or alone, for recreational or medical rehabilitation purposes without having to hold a sex toy or vaginal dilator in one's hand, or having to ask a third party.

Sexual assistance apparatuses of the type indicated above and intended for able-bodied or disabled persons are described in the patent documents set out below. In these sexual assistance apparatuses, known to support the user, functionality and modularity are not combined to offer a broad field of use irrespective of the orientations and sexual practices of the users alone or in a couple.

The volume measurement and bulk of some of these apparatuses are quite substantial and restrictive for everyday and household use. Others can be folded and are not cumbersome to use and store. However, access and usage safety do not appear to have been achieved for disabled persons.

U.S. Pat. No. 7,524,283 B1 describes a machine made up of a stationary base and moving platform (on which a user is placed) with alternating movement with an off-centered system controlled by a motor. A phallic sex toy is secured to said stationary base for sexual assistance for one person alone. This machine also allows a pair of partners to have a sexual encounter, a first partner being upright and a second partner reclining on the moving platform. The latter is suitable for a disabled user. The movement frequency of the moving platform supporting the disabled user is from 10 to 200 cycles per minute, which is difficult to imagine in the upper range (for example, at more than 100 cycles per minute). The utility of this machine is limited to phallic sex toys for one user alone or in a couple (with an upright partner). Accessibility for disabled persons appears random, in particular in the example application on a sex table. Indeed, the machine according to U.S. Pat. No. 7,524,283 B1 does not take into consideration a notion of transfer from a wheelchair onto the sex table and its safety aspect, or the degree of disability.

US 2003/0111876A1 describes an oscillating bench able to support a user who, under the action of arms, legs or other moving parts of the user's body, causes a moving support to oscillate. A phallic sex toy is secured to the structure for sexual assistance for one person alone. A standing person may also have a sexual encounter with the user of the oscillating bench. However, this oscillating bench is not provided to be used by a disabled person.

U.S. Pat. No. 7,431,036 B2 describes an apparatus on a stand allowing disabled persons to have a sexual encounter with an able-bodied person. This apparatus has two coplanar platforms; the first platform is immobile because it is secured to the stand (to support a seated man) and the second platform is movable: it is suitable for a woman lying down such that the two partners are facing one another. The second moving platform moves linearly under the manual driving action of the seated man. This device is provided solely for a sexual encounter and does not have a mechanism for adding accessories such as sex toys.

US2008/0271241A1 describes a chair with a pendular movement on which a person is placed. The person may generate, using the hands and arms, an alternating movement of the seat bottom of the chair in order to have a sexual encounter with a partner present on a folding bed facing the chair. This chair and the bed are foldable, light and compact. This chair with pendular movement is provided solely for a sexual encounter and does not have a mechanism for adding accessories such as sex toys.

Other sexual assistance apparatuses are described in U.S. Pat. No. 6,190,552 B1, BE1018234A6, JPH08224274A.

More specifically, according to a first of its aspects, the invention relates to a modular sexual assistance apparatus suitable for being installed on the ground or on a bed and comprising a first secure structure able to support at least a first moving user. Said first secure structure comprises a moving carriage arranged on a linear guide and mounted on a first pedestal. The linear guide comprises a safety device.

Such a modular sexual assistance device is illustrated in FIG. 1 and is described in US2006/0004251A1. It is suitable for being installed on the ground or on a bed and in particular comprises a first secure structure 300 suitable for supporting at least a first moving user. Said first secure structure 300 comprises a moving carriage 306 arranged on a linear guide 302 and mounted on a first pedestal 304. The linear guide 302 comprises a safety device. The latter includes a plurality of guide wheels 310 and elastic return members 316.

The sexual assistance apparatus according to US2006/0004251A has a drawback: its linear guide 302 and, in particular, its safety device 310, 316, is insufficient to meet the specific needs of disabled users regarding control of a linear travel of the moving carriage 306.

To that end, it is recalled that these disabled persons often have no feeling below the pelvis. Likewise, they do not have fine control of their gestures. Yet these gestures are transmitted to the linear guide, which in turn determines, inter alia, a force and/or amplitude with which a sex toy (for example of the "phallic sex toy" or "orifice sex toy" type) connected to the sexual assistance apparatus acts on/in a body of the handicapped user. However, without feeling below the pelvis, this disabled user of the sexual assistance apparatus lacks reliable physiological feedback (for example, in the form of perceptible pain). As a result, the user is unable to adjust the gestures (necessarily imperfect because difficult to control, as explained above) in time to limit a movement of the linear guide and, in fine, the force and/or amplitude with which said sex toy acts on/in the body. This complex dynamic reality (due simultaneously to the uncertain gesture and the absence of the reliable feedback signal) specific to disabled users of the sexual assistance apparatus imposes particular constraints on the linear guiding to avoid complications such as:

vaginally or anal lesions during a brutal or excessive intrusion of a phallic sex toy;

fracture of the penis during an impact related to a missed penetration of an orifice sex toy.

As illustrated in FIG. 1, the elastic return members 316 are provided with open hooks that can easily unhook (either from the first pedestal 304, or from the moving carriage 306), randomly, at any moment, in particular due to the uncertain and/or poorly controlled gesture (without said feedback signal) by the disabled user. This may cause either one of the serious complications mentioned above, or a derailment of the first structure 300 following a departure of the guide wheels 310 from the linear guide 302. Such a derailment may cause the disabled user to fall, which is unsatisfactory.

The present invention, which is based on this original observation, primarily aims to propose a modular sexual assistance apparatus seeking at least to reduce a previously mentioned limitation. To that end, the modular sexual assistance apparatus, also according to the general definition above, is characterized in that:

the safety device is suitable for controlling a linear travel of the moving carriage, the linear guide comprises a system for slaving the carriage by a first tensed elastic cable, the first elastic cable includes a stopper ball and is suitable for entering both a locking catch secured to the first pedestal and a first ring secured to the carriage, and a first tensed state of the first elastic cable is defined both by a movement of the stopper ball along the first pedestal and by a clamped state of the first elastic cable in the locking catch.

Owing to this arrangement, the linear guide has an architecture that guarantees a disabled user an increased level of safety and reliability. Indeed, the slaving system of the carriage by the first tensed elastic cable makes it possible to control and limit a travel of the moving carriage (owing to a selective stiffness of said first elastic cable adapted to this use). In addition, the first elastic cable cannot unhook easily and/or randomly because its passage is secured with:

the stopper ball at the locking catch secured to the first pedestal, and the first ring secured to the carriage.

Lastly, the first tensed state of the first elastic cable has a double adjustment (by pulling it by the stopper ball and gripping it in the locking catch). This allows the disabled user to precisely adjust a desired travel of the moving carriage such that this travel is not disrupted by the poorly controlled gesture. As an example, it is thus possible to precisely limit an amplitude of the travel of the moving carriage to just a few centimeters so that a disabled man only penetrates the orifice sex toy with the gland of his penis. This broadens the functional possibilities of the modular sexual assistance apparatus according to the invention and, in particular, makes it suitable for medical rehabilitation related to sexual pathologies in disabled persons.

Preferably, the carriage comprises a bumper. Furthermore, the safety device includes a second cable connected to a front stop secured to the first pedestal and to a second rear ring secured to the carriage. Under these conditions, a beginning of linear travel of the carriage is defined by the bumper cooperating with the front stop and the second cable has a second tensed state at the end of linear travel of the carriage.

Owing to this arrangement, it is possible to provide secure linear guiding of the moving carriage with free and finely controlled amplitude, according to physicians' requirements during medical rehabilitation related to sexual pathologies in disabled persons.

Preferably, the safety device includes at least one from among the following modules: (a) adjustable railing bar suitable for serving as a bearing point for the first user; (b) adjustable backrest including an adjustable neck brace suitable for supporting the body of the first user; (c) adjustable lateral safety barrier suitable for stabilizing a position of the first user on the moving carriage; (d) removable lateral safety barrier suitable for facilitating access to the first user; (e) adjustable leg orthosis suitable for supporting the leg of the first user; (f) hand support block suitable for supporting the hand of the first user; (g) belt suitable for strapping the first moving user on the moving carriage.

This arrangement broadens the functional possibilities of the modular sexual assistance apparatus according to the invention and, in particular, makes it appropriate, ergonomically speaking (in particular in terms of adjustment), irrespective of a position (seated, reclining, on the knees) recommended by the physician during the medical rehabilitation related to the sexual pathologies in the disabled persons.

Advantageously, the first pedestal can be supported by crosspieces.

This arrangement makes the modular sexual assistance apparatus according to the invention both more stable and more compact. This broadens its functional possibilities by making said apparatus easy to manipulate and/or transport by the disabled user (the weight of the apparatus being limited, preferably, to 6 kg). Likewise, these crosspieces (which can be removable to facilitate the transport of said apparatus) make it possible to stabilize the first pedestal on a mattress of a bed for increased fall prevention safety of the disabled user.

Preferably, the safety device includes an adjustable railing bar suitable for serving as a support for the first user. Under these conditions, the modular sexual assistance apparatus includes a video tablet positioned on the adjustable railing bar using a first support.

This broadens the functional possibilities of the apparatus according to the invention. In particular, this makes it possible to give medical rehabilitation courses (related to the sexual pathologies in disabled persons) remotely, the physician intervening through telecommunications means connected to the video tablet.

Preferably, the modular sexual assistance apparatus according to the invention includes a second secure structure able to support at least one second moving user. The second secure structure is identical to the first secure structure, the first and second structures being coupled to one another adjustably, and being suitable for allowing the first and second users to have a sexual encounter while being seated, facing one another.

This arrangement broadens the functional possibilities of the apparatus according to the invention. In particular, this makes it possible to ensure nondiscrimination of the first disabled user relative to the second able-bodied user. Furthermore, this architecture reflects a modular spirit of the modular sexual assistance apparatus according to the invention designed for medical rehabilitation purposes related to sexual pathologies in disabled persons to allow the patient to use it later in everyday life. This reinforces a beneficial psychological impact of said medical rehabilitation.

Preferably, the modular sexual assistance apparatus according to the invention comprises a base adjustably connected to the first pedestal and bearing a second support including an adjustable mechanical interface suitable for attaching a sex toy.

This arrangement broadens the functional possibilities of the apparatus according to the invention by making it more ergonomic for persons in disabled situations irrespective of their body type (height, weight), type of disability, or sexual practices.

Preferably, the mechanical interface is articulated and is connected to the second support in an indexed and adjustable position.

This arrangement broadens functional possibilities of the apparatus according to the invention by making it more ergonomic for handicapped users irrespective of body type (height, weight), type of handicap, or sexual practices.

Alternatively, the mechanical interface can be dual and connected to the second support in an indexed and adjustable position.

This arrangement broadens functional possibilities of the apparatus according to the invention by making it more ergonomic for handicapped users irrespective of body type (height, weight), type of disability, sexual practices.

According to a second of its aspects, the invention relates to a use of the modular sexual assistance apparatus described above for medical rehabilitation related to sexual pathologies in disabled persons.

Figure 2:
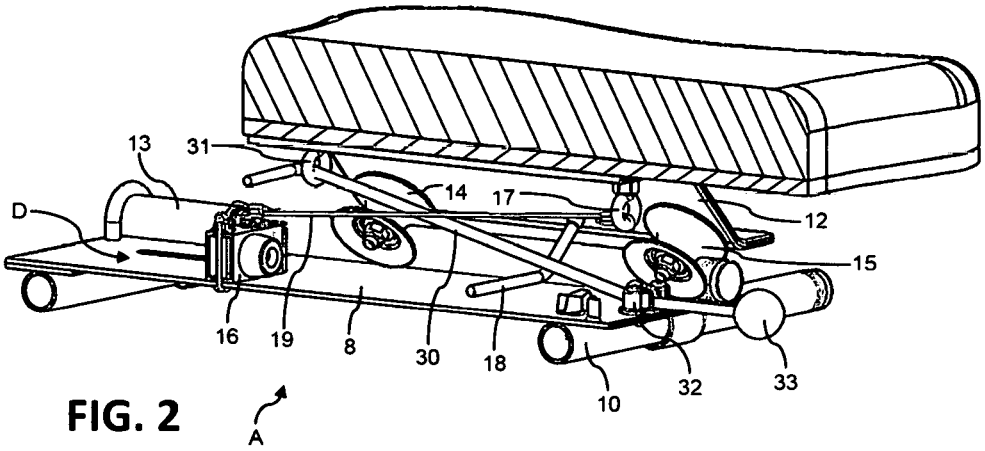
Figure 5:
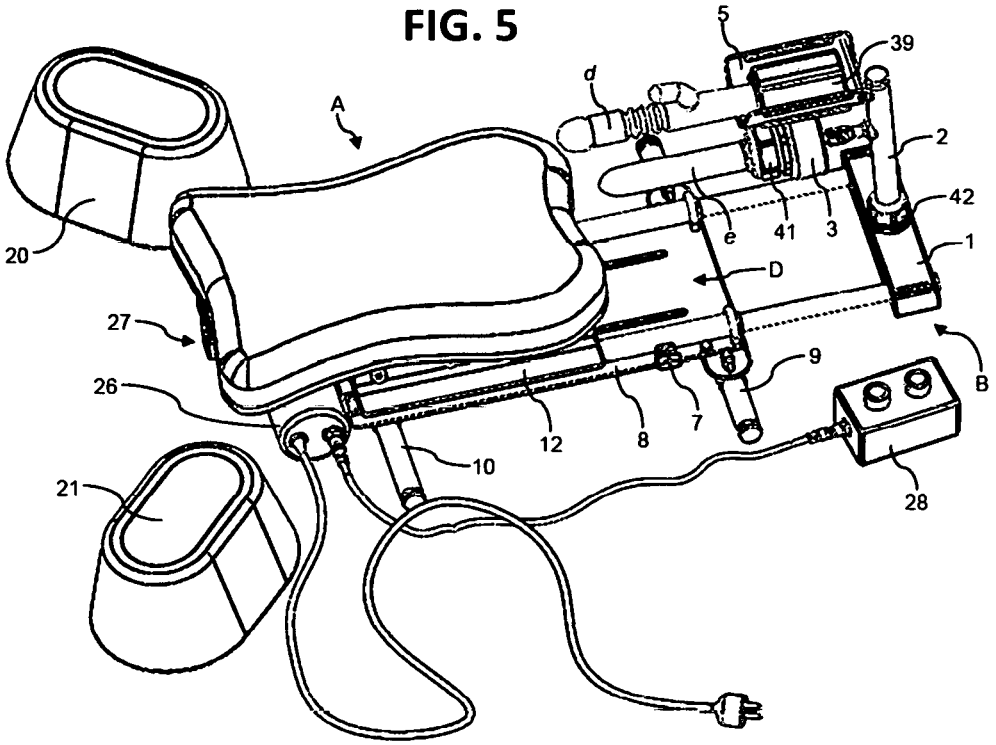
Figure 6:
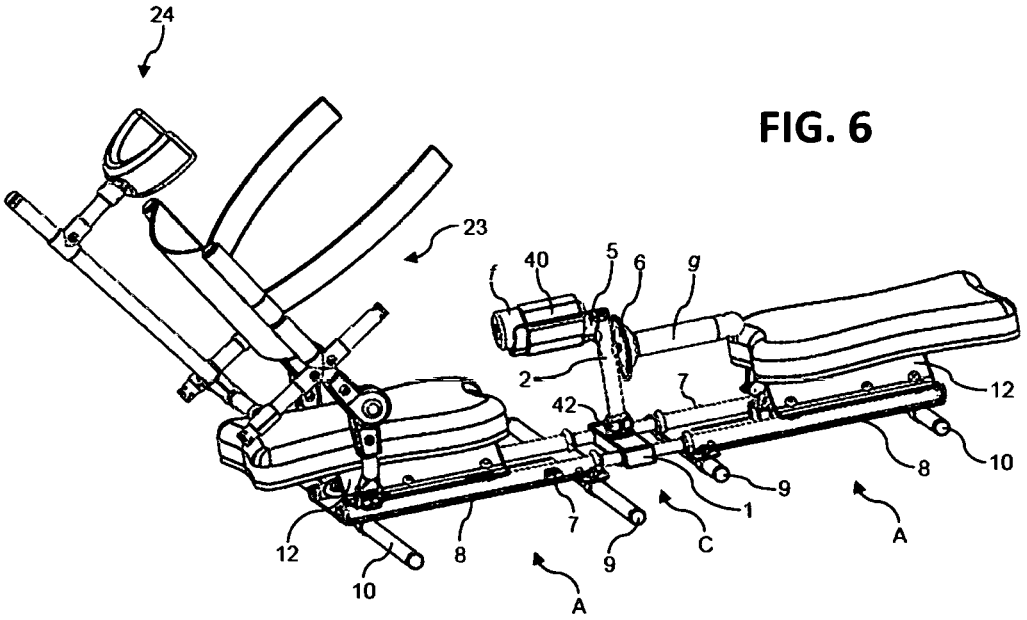

Other features and advantages of the invention will clearly emerge from the description thereof provided below, for information and non-limitingly, in reference to the appended drawings, in which:

FIG. 1 schematically shows an exploded perspective view of a known modular sexual assistance apparatus described in US2006/004251A1;

FIG. 2 schematically shows a detailed sectional perspective view of a structure of the modular sexual assistance apparatus according to the invention with a moving carriage arranged on a linear guide secured using a stop device and equipped with a slaving system by elastic cable;

FIG. 3 schematically shows a perspective view of a first alternative of the modular sexual assistance apparatus according to the invention equipped with lateral safety barriers and railing bars;

FIG. 4 schematically shows a perspective view of a second alternative of the modular sexual assistance apparatus according to the invention equipped with:

an adjustable backrest including an adjustable neck brace, and a system of leg orthoses adjustable on a pedestal;

FIG. 5 schematically shows a perspective view of a third alternative of the modular sexual assistance apparatus according to the invention, this third alternative being electrically motorized with a regulator and having two hand support blocks;

FIG. 6 schematically shows a perspective view of a fourth alternative of the modular sexual assistance apparatus according to the invention including two coupled structures, one of them being equipped with an adjustable backrest including an adjustable neck brace, the other of them being customized using a support bearing two sex toys.

The known state of the art shown in FIG. 1 has already been discussed above: its description is therefore not reiterated here.

As previously stated and illustrated in FIGS. 2 to 6, according to a first aspect, the invention relates to a modular sexual assistance apparatus suitable for being installed on the ground or on a bed and comprising a first secure structure A suitable for supporting at least a first moving user. Said first secure structure A comprises a moving carriage 12 arranged on a linear guide and mounted on a first pedestal 8. The linear guide comprises a safety device.

According to the invention, the safety device is suitable for controlling a linear travel of the moving carriage 12. FIG. 2 is a detailed view of a first structure A of the apparatus according to the invention, in sectional view, with a half-rolling train of the moving carriage 12 mounted on the linear guide. The latter is secured by a stop device and equipped with a slaving system by a first elastic cable 30, according to the invention. The linear guide is preferably made up of four dolly rollers, bolted on the moving carriage 12, for the half-train, 14 and 15, which roll on a rail 13. A linear travel of the moving carriage 12 is secured by a second cable 19 connected to a front stop 16. The latter is secured to the first pedestal 8. The second cable 19 is also connected to a second rear ring 17 secured to the moving carriage 12. The linear travel of the moving carriage 12 is defined by a contact of its bumper 18 with the front stop 16 and the second tensed cable 19.

In this FIG. 2, in section, a movement of the moving carriage 12 is slaved by an elastic cable tensioning system with longitudinal symmetry. The first elastic cable 30 equipped with a stopper ball 33 enters a locking catch 32 secured to the first pedestal 8. This first elastic cable 30 next travels to pass in a first ring 31 secured to the moving carriage 12. The tension of the first elastic cable 30 is obtained by pulling or releasing the stopper ball 33 more or less and releasing or not releasing the locking catch 32. In this configuration, the slaving by the first elastic cable 30 is provided for customization of the structure with a phallic sex toy, like that in FIG. 3. There is therefore a resistive force to the advance of the moving carriage 12, from its initial rear position to its final forward position, with the tension of the first elastic cable 30, during a penetration, and next assistance to return to the initial rear position. Another configuration, not shown, having the same locking catches 32, but with an opposite travel of the elastic cable, is provided for customization of the structure with an orifice sex toy like that of FIG. 3. For this reverse use, there is therefore a resistive force to the advance of the moving carriage 12, from its initial front position to its final rear position, with the tension of the first elastic cable 30, during a penetration, and next assistance to return to the initial forward position.

FIG. 3 shows the first structure A of the customized apparatus according to its first alternative and equipped with adjustable lateral safety barriers 22 and railing bars 11, according to the invention, usable by a disabled person. This first alternative of the apparatus primarily comprises the first structure A made up of the first pedestal 8, the moving carriage 12, a one-way multifunctional device B and a support 2 (called "second" support 2 hereinafter) for mechanical interfaces.

The apparatus with its first pedestal 8 supported by crosspieces 9 and 10 as well as by the railing device 11 (bars) makes the installation of the apparatus on the ground or on a bed easy.

In this FIG. 3, the customization is done with:

an orifice sex toy h fastened with an elastic strap 34 on a fitting D of the first pedestal 8;

a vibrating phallic sex toy a, the control of which at its end is gripped by a first packing gland 41 that is an integral part of the articulated mechanical interface 3 connected to the second support 2 by an indexed and adjustable position;

a video tablet on a support 29 (called "first support" 29 hereinafter) positioned on the front bar of the railings 11.

The second support 2 thus equipped, easily removable for usage reasons, is gripped in the adjusted vertical position by a second packing gland 42 of the base 1 of the one-way multifunctional device B. The ergonomics are adjusted by a linear movement of the one-way multifunctional device B thus equipped and blocked in position on the first pedestal 8 by a gripping button 7.

The lateral safety barriers 22, adjustable in longitudinal and laterally angular position, with baffled planar bases inserted in the apertures to that end on the borders of the moving carriage 12, are removable to facilitate access for the disabled user and suitable for the latter's body type to prevent rolling or tilting on the side.

In this first configuration of the apparatus, the user (for example, a disabled man) is reclining on his stomach on the moving carriage 12. The to-and-fro movement, with a controlled amplitude, is generated by this user, whose hands grip the front bar of the railings 11, by flexion and extension of the arms. For increased safety, but more restrictive on a cognitive level, a belt (not shown) can be used to strap the disabled user on the moving carriage 12.

FIG. 4 shows a second alternative of the apparatus according to the invention with the first structure A of the customized apparatus, equipped with:

an adjustable backrest 23 including an adjustable neck brace 24, and a system of two leg orthoses 35, 36 adjustable on a second pedestal 37 separate from the first pedestal 8.

The base of this apparatus is the same as that of FIG. 3 and primarily comprises the first structure A made up of the first pedestal 8 supported by the crosspieces 9 and 10, the moving carriage 12, the one-way multifunctional device B and the second support 2 for mechanical interfaces.

In this FIG. 4, the customization is done with two phallic sex toys b and c clipped (i.e., attached using a clip made up of two parts articulated around a spring means to form a clamp) on a double mechanical interface 4 connected to the second support 2 on a suitable indexed and adjustable position. Next, this second support 2 is adjusted on the second packing gland 42 of the base 1 of the one-way multifunctional device B, the ergonomic adjustment of the assembly and the blocking in position are respectively identical to those described above in connection with FIG. 3.

The backrest 23 adjustable in angular position having the neck brace 24 adjustable for the morphology of the user is fastened on either side on the moving carriage 12. This backrest 23 is adjustable in longitudinal position during the use in the seated position to offer ergonomic comfort.

The second pedestal 37 (separate from the first pedestal 8) connected to the front of the first structure A has two leg orthoses 35 and 36, on which each of the leg of the paraplegic or tetraplegic user is strapped, adjustable in longitudinal, lateral position and having a slight degree of vertical angular freedom via an articulation on a blade 38 with suitable stiffness, to follow the slight genuflection during the developed gesture in order to keep the lower limbs of the user in the best ergonomic position for use of the apparatus in the seated position.

FIG. 5 shows a third alternative of the apparatus according to the invention with the first structure A of the apparatus motorized using an electric motor with regulator and that is customized. The base of this apparatus is the same as that of FIG. 3 and primarily comprises the first structure A made up of the first pedestal 8 supported by the crosspieces 9 and 10, the moving carriage 12, the one-way multifunctional device B and the second support 2 for mechanical interfaces.

The first structure A is motorized with a rotary electric motor 26 that is fastened on the first pedestal 8, translating a device 27 with cylindrical rack mounted on two supports with shaft secured to the moving carriage 12. The rotary electric motor 26 is controlled by a regulator 28 to adjust the travel and movement speed of the moving carriage 12 thus slaved. The slaving for the movement and control of the moving carriage 12 can be done with any equivalent device (linear electric motor, motorized linear guiding, hydraulic linear guiding, etc.).

Two foam hand support blocks 20 and 21, coplanar with the seat bottom, are freely positioned in order to offer suitable ergonomic comfort for the use of the apparatus in the seated position and the arms bearing toward the rear.

In this FIG. 5, the customization of the apparatus according to the invention is done with:

on the one hand, in the lower indexed position on the second support 2, an articulated mechanical interface 3 equipped with a phallic sex toy e, as shown in FIG. 2, and on the other hand, in the upper indexed position on the second support 2, a mechanical interface of the cradle type 5 equipped with a multi-command vibrating sex toy d fastened by an elastic strap 39.

Next, this second support 2 is adjusted on the second packing gland 42 of the base 1 of the one-way multifunctional device B, the ergonomic adjustment of the assembly and the blocking in position are respectively identical to those described above in connection with FIG. 3.

FIG. 6 shows a fourth alternative of the apparatus according to the invention that is customized. It includes two first structures A, one of them being equipped with a backrest with a neck brace, the other of them being single. These two first structures A are modulated and coupled by a two-way multifunctional device C allowing an ergonomic adjustment of the first two structures A relative to one another. The ergonomics are adjusted by a linear movement of the two-way multifunctional device C thus equipped and blocked in position on each of the pedestals 8 of both of the first structures A and by each of the gripping buttons 7.

In this FIG. 6, the customization is done with, on the second support 2:

on the one hand, in the position facing the first structure A equipped with the backrest with the neck brace, a mechanical interface of the cradle type 5 equipped with an orifice sex toy f fastened by an elastic strap 40, and on the other hand in the opposite position facing the first single structure A, a mechanical interface of the disc type 6 equipped with a suction sex toy g.

Next, this second support 2 is adjusted on the second packing gland 42 of the base 1 of the two-way multifunctional device C.

In this fourth modular configuration, the coupling can be done with a single interfacing device, with no base 1 (not shown) allowing a couple to have a sexual encounter while being seated, one facing the other.

The set of components of the invention is defined out of a concern for optimization of the ease of use, safety, customization and modularity in order to arrive at an economical, robust, light, compact application for easy use and storage as well as cost control so as to be in line with market needs.

According to a second of these aspects, the modular apparatus according to the invention is particularly intended for recreational use as well as assistance, and/or for sexual compensation, and/or for medical rehabilitation related to sexual pathologies.

In summary, a first object of the invention is a base, adjustable in horizontal position and able to be blocked relative to a structure in a one-way plane, bearing a support for mechanical interfaces adjustable in vertical position intended to add accessories, for better customization of the apparatus.

A second object of the invention is a base identical to that of the first object of the invention, having the same functionality to customize the apparatus, with a support for two-way mechanical interfaces, but also making it possible to couple two structures, with an adjustment and blocking on the same two-way plane for the configurable aspect of the apparatus.

A third object of the invention is an arrangement on a pedestal of a structure of the apparatus, in front, to attach an orifice sex toy on the apparatus in its simple configuration.

Another main object is the position of the base on the front of each of the structures for obvious ergonomic reasons.

Devices for better safety and/or better comfort related to ergonomics for use by disabled persons, depending on their degree of disability, can be installed on the structure of the apparatus (hand support blocks, adjustable railings, two lateral safety barriers, adjustable backrest with a neck brace, two leg orthoses).

With this arrangement, a moving user or pair of users with the moving carriage on a linear guide, in a horizontal position, seated or on knees, can have a wide range of ergonomic uses irrespective of their orientations and sexual practices.

The travel of the moving carriage is secured by two stops.

The movement of the user on the apparatus is provided by the user's driving force, and/or by a third party, and/or by an electrically motorized device with a regulator, and/or by any linear slaving system.

The invention claimed is:

1. A modular sexual assistance apparatus suitable for being installed on a ground or on a bed and comprising a first secure structure able to support movements of at least a first user, the first secure structure comprising a movable carriage arranged on a linear guide and mounted on a first pedestal, the linear guide comprising a safety device, wherein the safety device is suitable for controlling a linear travel of the movable carriage, wherein the linear guide comprises a system for slaving the movable carriage by a first tensed elastic cable, wherein the first tensed elastic cable includes a stopper ball and is suitable for entering both a locking catch secured to the first pedestal and a first ring secured to the movable carriage, and wherein a first tensed state of the first tensed elastic cable is defined both by a movement of the stopper ball along the first pedestal and by a clamped state of the first tensed elastic cable in the locking catch.

2. The modular sexual assistance apparatus according to claim 1, wherein the movable carriage comprises a bumper, wherein the safety device includes a second cable connected to a front stop secured to the first pedestal and to a second rear ring secured to the movable carriage, wherein a beginning of linear travel of the movable carriage is defined by the bumper cooperating with the front stop, and wherein the second cable has a second tensed state at the end of linear travel of the movable carriage.

3. The modular sexual assistance apparatus according to claim 2, wherein the safety device includes at least one from among the following modules:

(a) an adjustable railing bar suitable for serving as a bearing point for the first user;

(b) an adjustable backrest including an adjustable neck brace suitable for supporting the body of the first user;

(c) an adjustable lateral safety barrier suitable for stabilizing a position of the first user on the movable carriage;

(d) a removable lateral safety barrier suitable for facilitating access to the first user;

(e) an adjustable leg orthosis suitable for supporting the leg of the first user;

(f) a hand support block suitable for supporting the hand of the first user;

(g) a belt suitable for strapping the first user on the movable carriage.

4. The modular sexual assistance apparatus according to claim 2, wherein the first pedestal is supported by cross-pieces.

5. The modular sexual assistance apparatus according to claim 2, wherein the safety device includes an adjustable railing bar suitable for serving as a support for the first user, and wherein the modular sexual assistance apparatus includes a video tablet positioned on the adjustable railing bar using a first support.

6. The modular sexual assistance apparatus according to claim 2, wherein the apparatus includes a second secure structure able to support movements of at least one second user, the second secure structure being identical to the first secure structure, the first and second structures being coupled to one another adjustably, and being suitable for allowing the first and second users to have a sexual encounter while being seated, facing one another.

7. The modular sexual assistance apparatus according to claim 2, wherein the apparatus comprises a base adjustably connected to the first pedestal and bearing a second support including an adjustable mechanical interface suitable for attaching a sex toy.

8. The modular sexual assistance apparatus according to claim 1, wherein the safety device includes at least one from among the following modules:

(a) an adjustable railing bar suitable for serving as a bearing point for the first user;

(b) an adjustable backrest including an adjustable neck brace suitable for supporting the body of the first user;

(c) an adjustable lateral safety barrier suitable for stabilizing a position of the first user on the moving carriage;

(d) a removable lateral safety barrier suitable for facilitating access to the first user;

(e) an adjustable leg orthosis suitable for supporting the leg of the first user;

(f) a hand support block suitable for supporting the hand of the first user;

(g) a belt suitable for strapping the first user on the movable carriage.

9. The modular sexual assistance apparatus according to claim 8, wherein the first pedestal is supported by cross-pieces.

10. The modular sexual assistance apparatus according to claim 8, wherein the safety device includes the adjustable railing bar suitable for serving as a support for the first user, and wherein the modular sexual assistance apparatus includes a video tablet positioned on the adjustable railing bar using a first support.

11. The modular sexual assistance apparatus according to claim 8, wherein the apparatus includes a second secure structure able to support movements of at least one second user, the second secure structure being identical to the first secure structure, the first and second structures being coupled to one another adjustably, and being suitable for allowing the first and second users to have a sexual encounter while being seated, facing one another.

12. The modular sexual assistance apparatus according to claim 1, wherein the first pedestal is supported by cross-pieces.

13. The modular sexual assistance apparatus according to claim 12, wherein the safety device includes an adjustable railing bar suitable for serving as a support for the first user, and wherein the modular sexual assistance apparatus includes a video tablet positioned on the adjustable railing bar using a first support.

14. The modular sexual assistance apparatus according to claim 12, wherein the apparatus includes a second secure structure able to support movements of at least one second user, the second secure structure being identical to the first secure structure, the first and second structures being coupled to one another adjustably, and being suitable for allowing the first and second users to have a sexual encounter while being seated, facing one another.

15. The modular sexual assistance apparatus according to claim 1, wherein the safety device includes an adjustable railing bar suitable for serving as a support for the first user, and wherein the modular sexual assistance apparatus includes a video tablet positioned on the adjustable railing bar using a first support.

16. The modular sexual assistance apparatus according to claim 1, wherein the apparatus includes a second secure structure able to support movements of at least one second user, the second secure structure being identical to the first secure structure, the first and second structures being coupled to one another adjustably, and being suitable for allowing the first and second users to have a sexual encounter while being seated, facing one another.

17. The modular sexual assistance apparatus according to claim 1, wherein the apparatus comprises a base adjustably connected to the first pedestal and bearing a second support including an adjustable mechanical interface suitable for attaching a sex toy.

18. The modular sexual assistance apparatus according to claim 17, wherein the adjustable mechanical interface is articulated and is connected to the second support in an indexed and adjustable position.

19. The modular sexual assistance apparatus according to claim 17, wherein the adjustable mechanical interface comprises a first mechanical interface and a second mechanical interface, wherein the first mechanical interface and second mechanical interface are connected to the second support in an indexed and adjustable position.

20. Method for medical rehabilitation related to sexual pathologies in a disabled, person, comprising using the modular sexual assistance apparatus according to claim 1 by the disabled person as the first user.

* * * * *